United States Patent [19]

Mathias

[11] Patent Number: 4,674,388

[45] Date of Patent: Jun. 23, 1987

[54] CORD TUNING MECHANISM FOR GUITAR

[76] Inventor: John F. Mathias, 48 Lane 4, Gaspee Point, Warwick, R.I. 02888

[21] Appl. No.: 860,459

[22] Filed: May 7, 1986

[51] Int. Cl.[4] ..... G10D 3/14

[52] U.S. Cl. ..... 84/312 P

[58] Field of Search ..... 84/312 P, 315–317

[56] References Cited

U.S. PATENT DOCUMENTS

| | | | |
|---|---|---|---|
| 2,459,102 | 1/1949 | Adair | 84/312 P |
| 3,014,395 | 12/1961 | Blair | 84/312 P |
| 3,452,635 | 7/1969 | Sebers et al. | 84/312 P |

*Primary Examiner*—Lawrence R. Franklin

*Attorney, Agent, or Firm*—Barlow & Barlow

[57] ABSTRACT

A stringed musical instrument of the Hawaiian guitar type has a plurality of parallel strings that are led through a plurality of tensioning pins. The pins which are spring loaded in a tensioning attitude, may be partially moved in an upwardly direction to release a portion of the tension on a string. A plurality of levers are arranged to engage the ends of the pins to achieve the movement and the levers are moved by a plurality of cams that are mounted on shafts that extend transversely across the levers. The shafts are coupled to foot pedals.

2 Claims, 5 Drawing Figures

CORD TUNING MECHANISM FOR GUITAR

BACKGROUND OF THE INVENTION

There are a number of tuning devices for guitars which are designed to either vary the tuning of one string or a plurality thereof. These developments are due to the fact that when a Hawaiian style guitar is played, the fixed chords cannot be changed to an appreciable degree. For example, in the Bossier U.S. Pat. No. 2,914,982, there is disclosed a device for varying the tension of the strings in which levers are actuated which will increase the tension of a string. When tension is increased in this manner, it is found that the tuning does not stay accurate, and the solution is best seen by U.S. Pat. No. 2,534,431 where the normal pitch of the strings is decreased upon the operation of a lever. It is desirable, therefore, to provide a simple arrangement of accomplishing chord changes of the guitar and one which can be readily tuned by the user.

SUMMARY OF THE INVENTION

A Hawaiian guitar is provided with the usual array of six strings arranged in the following sequence: E, C♯, A, E, C♯, A. Levers are provided that engage pins associated with the C♯ and A strings, while the E strings are left alone. Accordingly, the strings are strung in the usual fashion from anchor points to tuning pegs, and near the anchor point a pin engages the four strings that are desired to be retuned. The pins are actuated by levers that are pivoted at one end thereof and extending transversely across the levers are operating shafts that through cams rock one or more of the levers depending upon the exact changes desired. This allows the playing of chords that are usually difficult to do with the usual technique.

DESCRIPTION OF THE PREFERRED EMBODIMENTS

Figure 1:
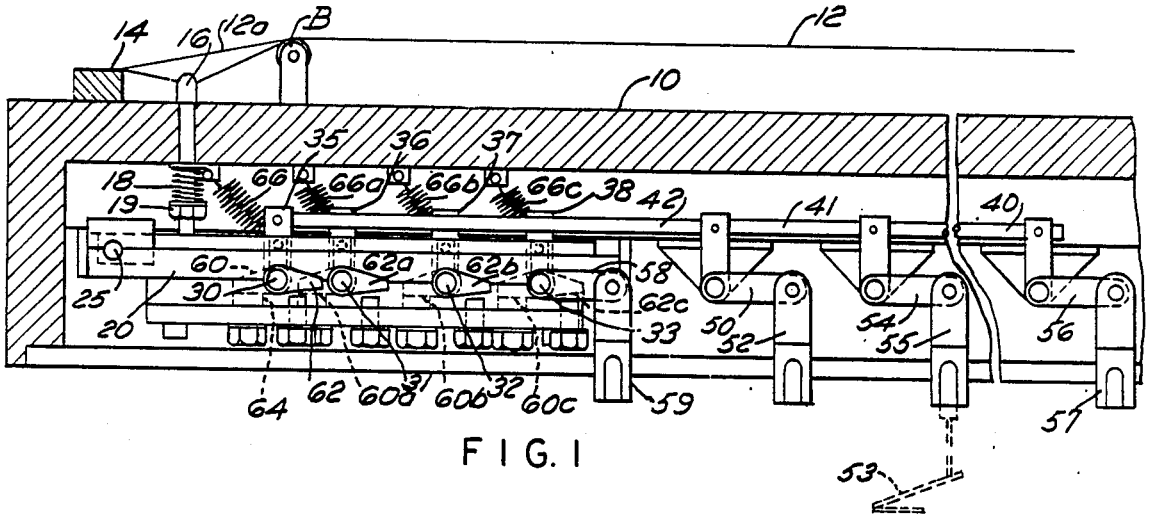
FIG. 1 is a side elevational view of the operating mechanism of the chord tuning device.
Figure 2:
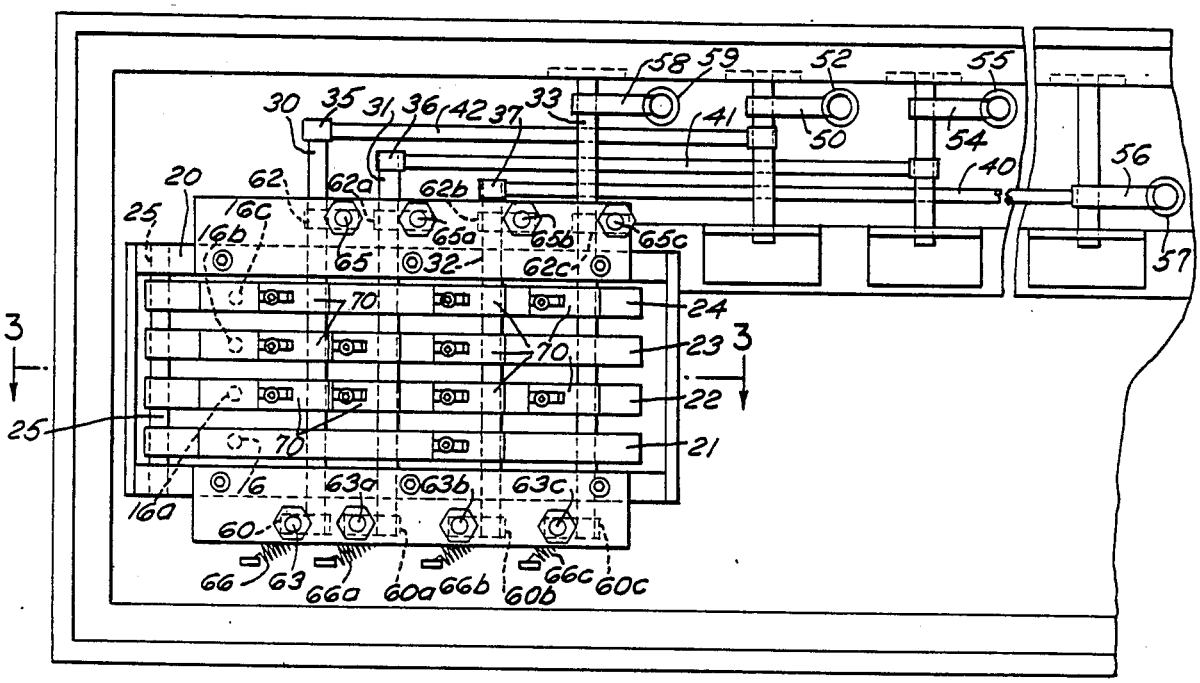
FIG. 2 is a bottom view thereof.

I have provided a Hawaiian guitar of usual construction. It consists of a horizontally disposed sounding board 10, and on the sounding board, arranged longitudinally thereof and in parallel relationship, are a plurality of strings such as 12 that are fixed as at 14 and then pass through a pin 16 and over a bridge B to individual tuning pegs (not shown). In this arrangement, there are a plurality of pins, the instant disclosure illustrating pins 16*a*, 16*b*; and 16*c*. It will be generally understood, therefore, that a string such as 12 which passes through the pin 16 and a string such as 12*a* which does not, and which may be considered the E string, are all held in the same horizontal plane so that a steel may be placed thereover and moved longitudinally thereof. The strings are tensioned whether they pass through the pins 16 or not, to what is considered a Hawaiian guitar standard tuning, referred to above. The pins 16, 16*a*, 16*b*, 16*c* are each biased in a down attitude, as seen in FIG. 1, by a compression spring 18 that acts between the sounding board 10 and a fixed nut and washer means 19. It is desirable, however, to produce different chords such as a major C chord, minor C chords, and diminished, augmented or 7th chords and to achieve this, there is provided on the underside of the sounding board 10, a frame 20 and within the rectangular frame 20 there is provided, as illustrated, four levers 21, 22, 23, and 24 each of which is pivoted to the frame by a common pivot shaft 25. The lower ends of the tuning pins 16, 16*a*, 16*b*, and 16*c*, are engaged by the levers 21, 22, 23, and 24, respectively.

Mounted transversely across the levers and through the frame 20 are a plurality of tuning shafts 30, 31, 32, and 33. On the operating end of each of these shafts is a rocker arm 35, 36, 37, 38, respectively, which arm is connected by operating rods 40, 41, 42, that are actuated, as seen in FIG. 1, by a crank and pedal rod coupler. For example, crank 50, 54, 56 and coupler 52, 55, 57 are the operators for rods 42, 41, 40 respectively. By way of example, a pedal 53, is illustrated connected to coupler 55, it being understood that a pedal is provided for all couplers. Shaft 33 is directly operated by the crank arm 58 and coupler 59.

At each end of the shafts 30, 31, 32, 33, there is provided a bell crank stop arm designated 60, 60*a*, 60*b*, 60*c* and a simple stop arm 62, 62*a*, 62*b*, 62*c*. One portion of arm 60, by way of example, rests against an adjustable post such as 63 that is surrounded by a rubber washer 64 while the other end has a tension spring 66, 66*a*, 66*b*, 66*c* that effectively returns the shafts 30, 31, 32, 33 to rest position. Each stop post 63, 63*a*, 63*b*, 63*c* is identical in structure and the structure is repeated in connection with posts 65, 65*a*, 65*b*, 65*c*.

Figure 3:
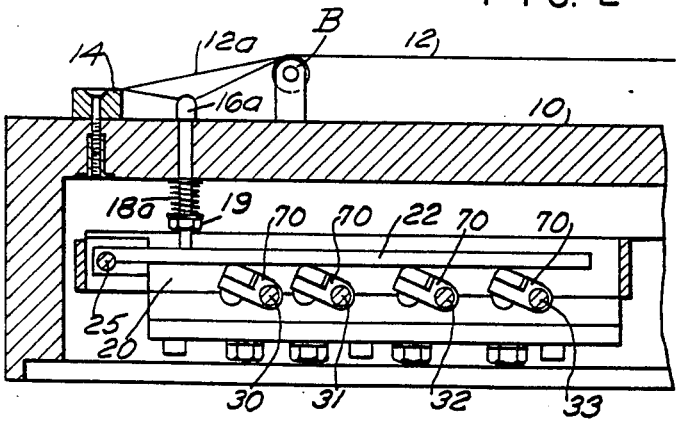
FIG. 3 is a sectional view taken on lines 3—3 of FIG. 2.
Figure 4:
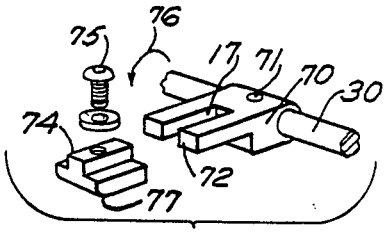
FIG. 4 is a detail of the adjustable cam and the operating shaft.
Figure 5:
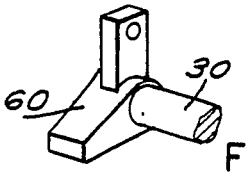
FIG. 5 is a detail of one of the bell crank stop arms.

Each of the shafts 30, 31, 32, and 33 are coupled to one or more of the operating levers 16, 16*a*, 16*b*, 16*c* by the use of the cam arrangement as seen in FIG. 3 and in enlarged form in FIG. 4. Inasmuch as the cams are identical, we can assume that the shaft which has been marked 30 could be any one of the four shafts to which there is fixedly attached a cam means in the form of a fork 70 that is riveted to the shaft as at 71, so as to provide a bifurcated end as 72. A T-bar 74 is arranged to slip within the bifurcated end, and a socket-head fastener, such as 75 will pass through a slot such as 17 and into the threaded bore in the T-bar 74. The shaft 30 will be rocked as seen by the arrow 76, and the surface 77 of the T-bar 74 will engage the surface of a lever and will push the lever upwardly raising the post 16 to cause at least a half a tone difference in a string. For more movement and for a full tone change, the T-bar is adjusted outwardly of the fork. As each shaft is rotated, the stops 62, 62*a*, 62*b*, 62*c* limit the degree of movement thereof, and in turn the effect of the cam means 74 on the individual levers.

In essence lever 21 engages pin 16 connected to A string, lever 22 engages pin 16*a* connected to C♯ string, lever 23 engages pin 16*b* connected to an A string, and lever 24 engages pin 16*c* connected to a C♯ string. It can be realized that when one actuates the shaft 33, for example, that the two C# strings will be lowered a half tone, respectively. When the shaft 32 is actuated, the C♯ strings because of the adjustment that is made in the coupling, that has been described in connection with FIG. 4, will be lowered one tone, and the two A strings lowered a half a tone. When shaft 31 is actuated, the A string will be lowered a tone, and the two C♯ strings will be lowered half a tone, while with shaft 30, the two C# strings are lowered half a tone, and the A string is lowered on tone, effectively giving us a major C chord that is made up of notes C, E, G.

I claim:

1. In a stringed musical instrument having a plurality of strings, a plurality of reciprocably mounted pins each engaging a string to tension the string and control the tone thereof, first spring means urging the pins into a rest position, a separate lever for each pin, said levers pivoted on a common axis, a plurality of rotationally mounted shafts extending transversely across said levers, each shaft having adjustable cam means engaging one or more selected levers and having a pair of lever arms fastened thereto, adjustable stops engaging said lever arms, spring means urging one lever arm against one rest to establish an original tone of a string and operating means rockingly coupling each shaft to a pedal.

2. In a stringed musical instrument having a plurality of strings, a plurality of reciprocably mounted pins each engaging a string to tension the string and control the tone thereof, first spring means urging the pins into a rest position, a separate lever for each pin, said levers pivoted on a common axis, a plurality of shafts extending transversely across said levers, each shaft having an adjustable fork fixedly attached thereto, the fork having a T-bar fitted therein to vary the length thereof, the fork adjustably engaging one or more selected levers, a lever arm acting as a stop to limit the movement of each shaft, an adjustable rest for the lever arm, spring means urging the lever arm against the rest and operating means coupling each shaft to a pedal.

* * * * *